US010954951B2

(12) United States Patent
Pelella et al.

(10) Patent No.: US 10,954,951 B2
(45) Date of Patent: Mar. 23, 2021

(54) ADAPTIVE ANTI SURGE CONTROL SYSTEM AND METHOD

(71) Applicant: Nuovo Pignone Tecnologie Srl, Florence (IT)

(72) Inventors: Marco Pelella, Florence (IT); Lorenzo Gallinelli, Florence (IT); Alessio Cacitti, Florence (IT)

(73) Assignee: NUOVO PIGNONE TECNOLOGIE SRL, Florence (IT)

( * ) Notice: Subject to any disclaimer, the term of this patent is extended or adjusted under 35 U.S.C. 154(b) by 100 days.

(21) Appl. No.: 16/315,504

(22) PCT Filed: Jul. 6, 2017

(86) PCT No.: PCT/EP2017/066978

§ 371 (c)(1),
(2) Date: Jan. 4, 2019

(87) PCT Pub. No.: WO2018/007544

PCT Pub. Date: Jan. 11, 2018

(65) Prior Publication Data

US 2019/0301477 A1 Oct. 3, 2019

(30) Foreign Application Priority Data

Jul. 7, 2016 (IT) ..... 102016000070842

(51) Int. Cl.
*F04D 27/02* (2006.01)
*F04D 27/00* (2006.01)
*F04D 31/00* (2006.01)

(52) U.S. Cl.
CPC ..... *F04D 27/0207* (2013.01); *F04D 27/001* (2013.01); *F04D 31/00* (2013.01)

(58) Field of Classification Search
None
See application file for complete search history.

(56) References Cited

U.S. PATENT DOCUMENTS

2011/0115223 A1* 5/2011 Stahlkopf ..... F01K 13/02 290/7
2012/0297772 A1* 11/2012 McBride ..... F01B 23/00 60/649

(Continued)

FOREIGN PATENT DOCUMENTS

EP 2325494 A1 5/2011
WO 20090131462 A2 10/2009
WO 2012007553 A1 1/2012

OTHER PUBLICATIONS

IT PCT Search Report and Written Opinion issued in connection with corresponding IT Application No. 102016000070842 dated Apr. 21, 2017.

(Continued)

*Primary Examiner* — Michael Lebentritt
(74) *Attorney, Agent, or Firm* — Baker Hughes Patent Organization

(57) ABSTRACT

A method of determining a liquid volume fraction in a multi-phase gas is disclosed. The method includes: a) measuring a first compressor operating parameter; b) selecting a tentative liquid volume fraction of the gas processed by the compressor; c) based on stored data representing a compressor operative curve for the tentative liquid volume fraction, determining an estimated value of a second compressor operating parameter, as a function of the first compressor operating parameter; d) measuring an actual value of the second compressor operating parameter; e) comparing the actual value of the second compressor operating parameter to the estimated value of the second compressor operating parameter and determining an error therefrom; f) based on the error, selecting a different tentative liquid volume fraction and repeating (c) to (e) until an error value equal to or lower than an error threshold is obtained.

22 Claims, 8 Drawing Sheets

(56) References Cited

U.S. PATENT DOCUMENTS

| | | | | |
|---|---|---|---|---|
| 2018/0223856 | A1* | 8/2018 | Gallinelli | F04D 17/12 |
| 2019/0024528 | A1* | 1/2019 | Baldassarre | F04D 27/0246 |
| 2019/0078574 | A1* | 3/2019 | Calosi | B01J 19/24 |
| 2019/0078575 | A1* | 3/2019 | Calosi | F04D 27/02 |
| 2019/0085854 | A1* | 3/2019 | Gallinelli | F04D 17/12 |
| 2019/0301478 | A1* | 10/2019 | Galeotti | F04D 27/0207 |

OTHER PUBLICATIONS

PCT Search Report and Written Opinion issued in connection with corresponding Application No. PCT/EP2017/066978 dated Sep. 25, 2017.

* cited by examiner

ADAPTIVE ANTI SURGE CONTROL SYSTEM AND METHOD

TECHNICAL FIELD

The present disclosure relates to compressor control methods and systems. Embodiments disclosed herein specifically relate to wet compressors, in particular centrifugal wet compressors, which process gas that can contain a liquid phase, e.g. heavy hydrocarbons, water or the like.

BACKGROUND OF THE INVENTION

Centrifugal compressors have been designed to process a so-called wet gas, i.e. gas that can contain a certain percentage of a liquid phase. Wet gas processing is often required in the oil and gas industry, where gas extracted from a well, such as a subsea well, can contain a liquid hydrocarbon phase, or water. For several reasons, it might be useful to know the liquid volume fraction (shortly LVF) of the gas processed by the compressor, i.e. the volume percentage of liquid in the fluid flow. Usually, the liquid volume fraction in the gas flow at the suction side of the compressor, however, is not known. Flowmeters capable of determining the liquid volume fraction are cumbersome and expensive and might not be suitable in certain applications in extreme environmental conditions.

A need therefore exists, for reliably and efficiently estimating the liquid volume fraction of a gas flowing through a compressor.

SUMMARY OF THE INVENTION

According to a first aspect, a method of determining a liquid volume fraction in a multi-phase gas processed by a compressor having a suction side and a delivery side is disclosed. The method can comprise the following steps:

a) measuring a first compressor operating parameter;

b) selecting a tentative liquid volume fraction of the gas processed by the compressor;

c) based on stored data representing a compressor operative curve for the tentative liquid volume fraction, determining an estimated value of a second compressor operating parameter as a function of the first compressor operating parameter;

d) measuring an actual value of the second compressor operating parameter;

e) comparing the actual value of the second compressor operating parameter to the estimated value of the second compressor operating parameter and determining an error therefrom;

f) based on the error, selecting a different tentative liquid volume fraction and repeating steps (c) to (e) until an error value equal to or lower than an error threshold is obtained.

The liquid volume fraction LVF contained in the gas processed by the compressor can thus be estimated without the need for direct measurement. The LVF determined by means of the above calculation can be used e.g. for adapting the anti-surge control of the compressor. An anti-surge control line can be selected based upon the liquid content in the wet gas, for optimal anti-surge operation.

The first compressor operating parameter can be the compression ratio or a parameter related thereto. In other embodiments, the first compressor operating parameter can be a parameter related to the compressor driving power, e.g. the corrected power. A definition of corrected power is given later on, reference being made to exemplary embodiments of the subject matter disclosed herein.

In some embodiments the second compressor operating parameter can be a parameter related to the compressor driving power, e.g. the corrected power. In other embodiments, the second compressor operating parameter can be the compression ratio or a parameter related thereto.

In some embodiments, the step of determining an estimated value of a second compressor operating parameter further comprises the step of:

based on stored data representing the compressor operative curve for the tentative liquid volume fraction, determining an estimated value of a third compressor operating parameter;

based on stored data representative of a further compressor operative curve for the tentative liquid volume fraction, and based on the estimated value of the third compressor operating parameter, determining the estimated value of the second compressor operating parameter.

According to a further aspect, disclosed herein is a system comprising:

a driver;

a compressor drivingly coupled to the driver and comprised of an anti-surge arrangement including an anti-surge line and an anti-surge control valve arranged there along;

a control unit functionally coupled to the anti-surge valve;

wherein the control unit is configured and controlled to perform a method as disclosed above.

According to another aspect, disclosed herein is a method of operating a wet-gas compressor, comprising the following steps:

running the compressor and processing a gas there through;

determining a liquid volume fraction of the gas at the suction side of the compressor;

selecting a surge control line as a function of the liquid volume fraction.

The method can further comprise the steps of:

providing sets of operating curves and surge control lines of the wet-gas compressor at different liquid volume fractions;

selecting the set of operating curves and respective surge control line corresponding to the determined liquid volume fraction.

According to some embodiments, the step of determining the liquid volume fraction at the suction side of the compressor can be performed repeatedly, e.g. at constant or variable time intervals, during operation of the compressor.

The step of determining the liquid volume fraction of the gas can comprise the step of detecting the amount of liquid in a multi-phase flow meter, or a step of estimating the amount of liquid, i.e. the liquid volume fraction, with an iterative method based upon operating parameters of the compressor.

According to a further embodiment, disclosed herein is a compressor system comprising:

a wet-gas compressor having a suction side and a delivery side;

an anti-surge arrangement comprising an anti-surge line fluidly coupling the delivery side and the suction side of the compressor and including an anti-surge control valve there along;

a control unit, functionally connected to the anti-surge control line, configured and arranged to: determine a liquid volume fraction of the gas at the suction side of the compressor; select a surge control line as a function of the liquid volume fraction; acting upon the anti-surge control valve to prevent the compressor from operating beyond the selected surge control line.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of embodiments of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. Embodiments of the invention are capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of embodiments of the present invention. It is important, therefore, that the claims be regarded as including such equivalent constructions insofar as they do not depart from the spirit and scope of embodiments of the present invention.

BRIEF DESCRIPTION OF THE DRAWINGS

A more complete appreciation of the disclosed embodiments of the invention will be readily obtained as the same becomes better understood by reference to the following detailed description when considered in connection with the accompanying drawings, wherein.

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit embodiments of the invention. Instead, the scope of embodiments of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

In the following description of exemplary embodiments, methods and systems will be described wherein the liquid fraction volume (shortly LFV) is estimated and used to act upon an anti-surge control algorithm of a centrifugal compressor. More specifically, the LVF is used to optimize the surge control line used in the anti-surge algorithm. It shall however be understood that the disclosed methods and systems for LVF estimation can be used for other purposes, whenever a measure of the liquid volume fraction in a wet gas is desired or useful.

Figure 1:
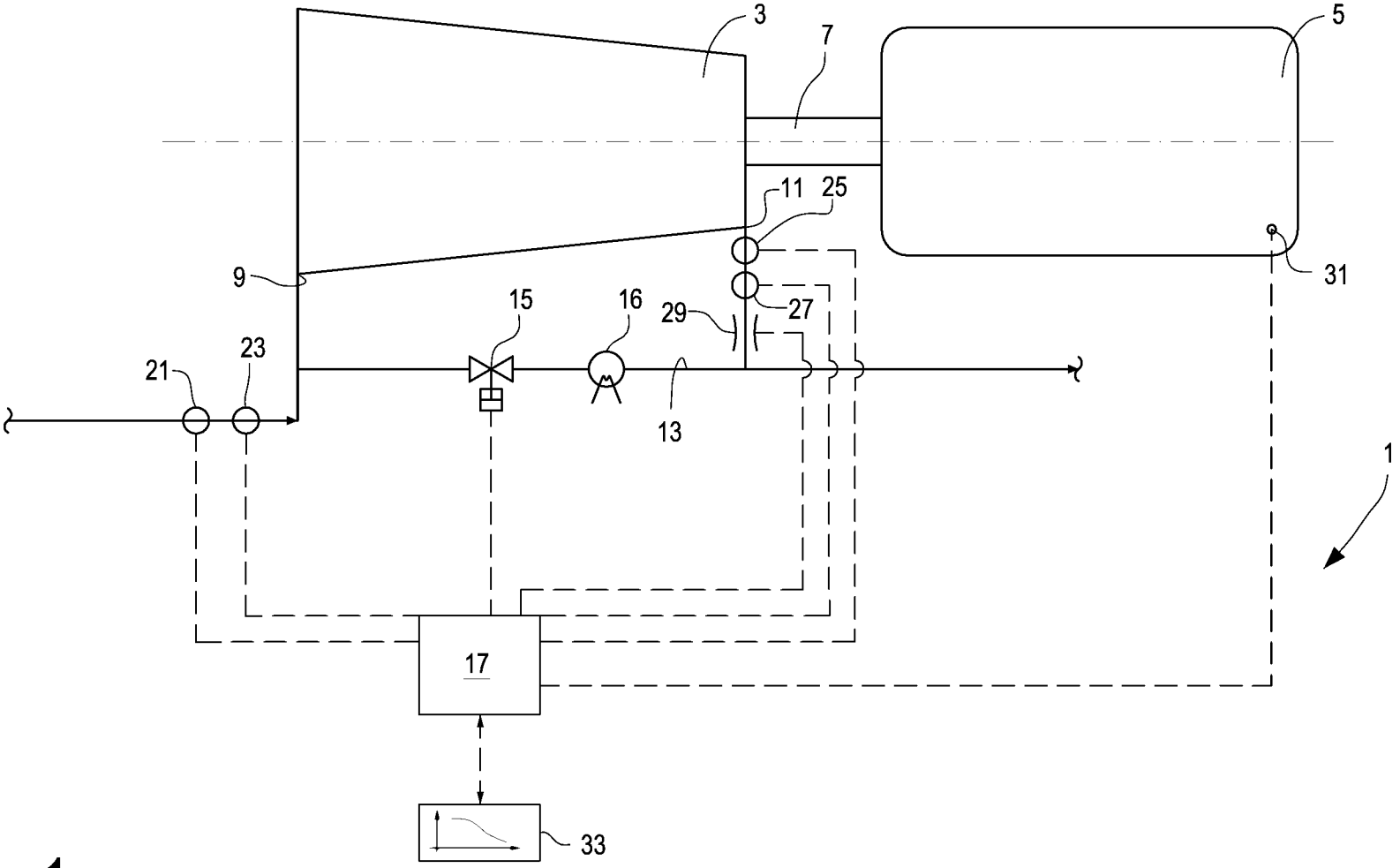
FIG. 1 illustrates a schematic of a system according to the present disclosure.

FIG. 1 schematically shows a compressor system 1. The compressor system 1 can e.g. be a subsea compressor system for pumping gas from a subsea gas well. The compressor system 1 comprises a compressor 3 and a driver 5, which drives the compressor 3 into rotation. Particularly in subsea applications, the driver 5 can be an electric motor. In other embodiments a different driver can be used, such as a gas turbine engine or a steam turbine, or an expander of an organic Rankine cycle.

The driver 5 is drivingly coupled to the compressor 3 by means of a drive shaft 7. The compressor 3 can be a centrifugal, multi-stage compressor. The compressor 3 and the driver 5 can be integrated in a single casing, not shown, forming a motor-compressor unit.

The compressor 3 has a suction side 9 and a delivery side 11. The suction side 9 receives gas at a suction temperature Ts and at a suction pressure Ps. The pressure of the gas is boosted by the compressor 3 and gas at a delivery pressure Pd and delivery temperature Td is delivered at the compressor delivery side 11.

The compressor 3 can be provided with an anti-surge arrangement. In some embodiments the anti-surge arrangement comprises an anti-surge line with an anti-surge control valve arranged therealong, the anti-surge line fluidly connecting the delivery side 11 of the compressor 3 to the suction side 9 of the compressor 3. According to the schematic of FIG. 1, an anti-surge line 13 is provided in an anti-parallel arrangement to the compressor 3. The anti-surge line 13 has an inlet coupled to the delivery side 11 of compressor 3 and an outlet coupled to the suction side 9 of the compressor 3. An anti-surge control valve 15 is arranged along the anti-surge line 13. A cooler 16 can be also provided along the anti-surge line 13. In other embodiments, the cooler is arranged on the discharge of the compressor, upstream of the anti-surge line branch. In yet further embodiments the cooler can be arranged on the compressor suction, downstream of the tie-in of the anti-surge line.

The anti-surge control valve 15 can be a bi-phase valve, i.e. a valve capable of handling a bi-phasic flow, containing gas and liquid.

The system 1 can be further comprised of a central control unit 17 and instrumentalities for measuring various operating parameters of the system 1. In some embodiments, a pressure transducer 21 and a temperature transducer 23 can be arranged and configured for measuring the suction pressure Ps and the suction temperature Ts. A pressure transducer 25 and a temperature transducer 27 can also be provided, to measure the delivery pressure Pd and the delivery temperature Td. In the exemplar embodiment of FIG. 1, a flow meter 29 is arranged for measuring the volumetric flowrate QVD at the delivery side of the compressor. A power transducer schematically shown at 31 can be used to measure the compressor driving power, i.e. the power required to drive the compressor 3. In some embodiments, the power required to drive the compressor can be measured by detecting the torque and the rotation speed. According to other embodiments, the actual power generated by the driver can be calculated. If the compressor driver is a gas or steam turbine, thermodynamic operating parameters of the turbine can be used to calculate the power. If the compressor driver is an electric motor, a transducer can be used, which measures the power required by the driver, e.g. a wattmeter.

The transducers 23-31 are functionally connected to the central control unit 17. This latter can be further provided with memory resources 33, wherein data representing operating curves, i.e. performance characteristics of the compressor 3 are stored. Possible operating curves useful to operate the methods of the present disclosure will be described here below. The data of the curves can be stored in the form of tables or matrices, for instance. In other embodiments, functions or algorithms can be stored to calculate the values of the operating curves.

The operating condition of the compressor 3 shall be carefully controlled to prevent surging phenomena. These occur when the compressor is operated in off-design conditions at low flowrate and high compression ratio. Surging affects the whole machine and is aerodynamically and mechanically undesirable. It can cause vibrations, lead to flow reversal and seriously damage the compressor and the compressor driver and can negatively affect the whole cycle operation. To prevent surging, the compressor is controlled such as to remain at a distance from a surge limit line defined in a compression ratio vs. corrected flowrate diagram. A surge control line, also known as surge avoidance line, is usually set at a distance of the surge limit line and the compressor is controlled such that the operating point thereof remains within an operating envelope delimited by the surge control line. When the operating point of the compressor approaches the surge control line, the anti-surge control valve 15 is opened and gas is returned from the compressor delivery side 11 to the compressor suction side 9. Thus, the compressor operating point in a compression ratio vs. flowrate diagram is moved away from the surge control line and back in a safety operation area.

Re-circulating gas through the anti-surge line 13 causes power losses, since part of the gas which has been compressed in a power-consuming compression process is returned to the suction side of the compressor at the suction pressure. The corresponding power which has been spent to compress the recirculated gas flow is wasted.

A careful setting of the surge control line and a careful control of the compressor are desirable in order to prevent surging phenomena but at the same time avoiding recirculation of unnecessarily large amounts of compressed gas.

The process gas entering the compressor 3 at the suction side 9 thereof can be in dry conditions, i.e. containing no liquid volume fraction (LVF=0). In some operating conditions, however, the process gas can contain a significant amount of liquid phase. The liquid volume fraction LVF can be e.g. from about 0% to about 3%, which can correspond to a liquid mass fraction (LMF) from about 0% to 30%. It shall be noted that the upper limit is given by way of example only and shall not be construed as a limiting value.

During compression, the gas temperature increases and the liquid volume fraction can drop or even become zero. In some operating conditions, however, liquid can be present also in the gas flow at the delivery side 11 of the compressor 3.

Figure 2:
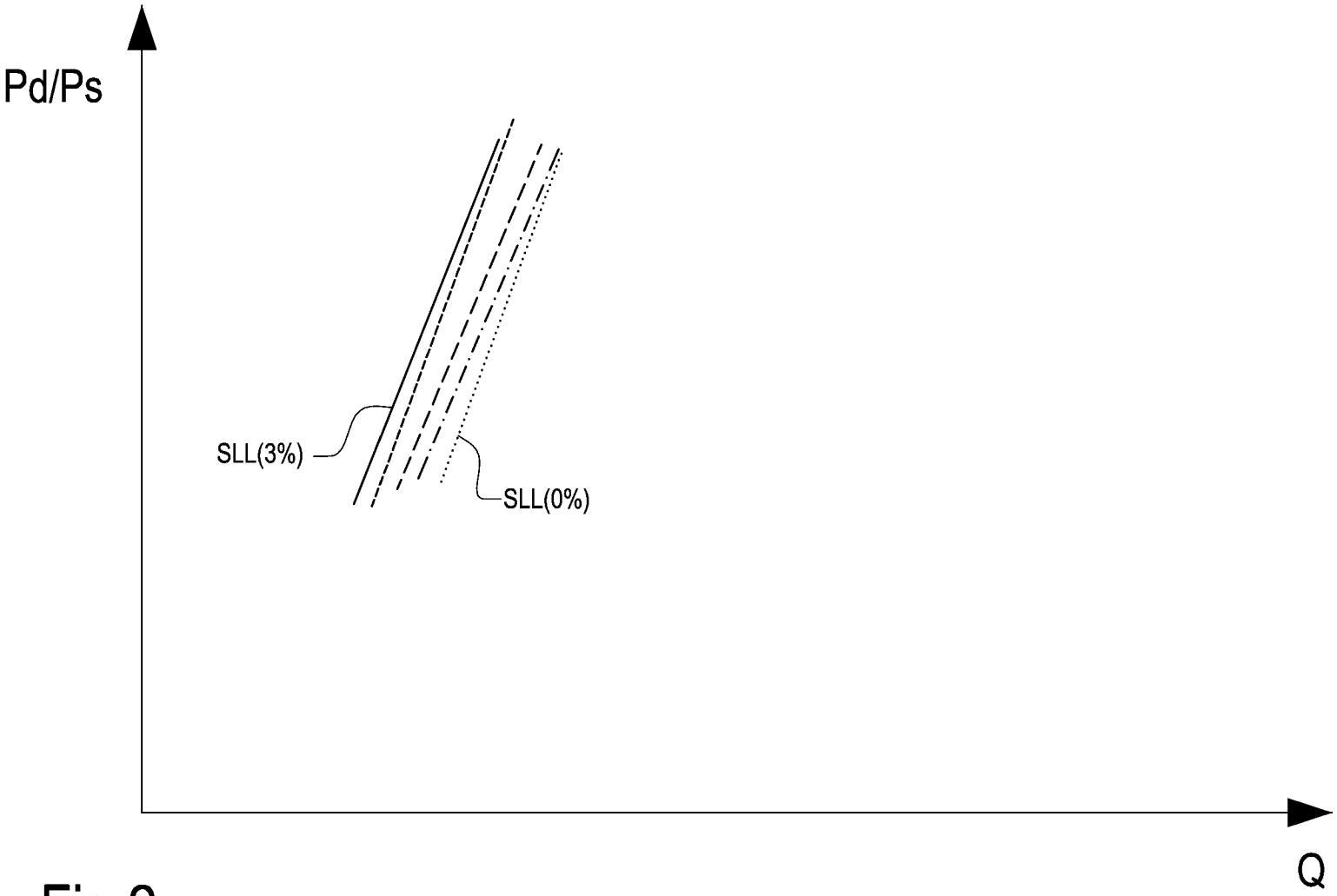
FIG. 2 illustrates a diagram showing several surge limit lines in a flowrate vs. compression ratio diagram for a centrifugal compressor, at different liquid volume fractions.

It has been noted that if wet gas is processed, the surge limit line in a compression ratio vs. flowrate diagram moves from the right to the left as the liquid volume fraction LVF increases. FIG. 2 illustrates, for instance, a family of surge limit lines (SLL) for variable LVF values in a compression ratio vs. volumetric flowrate diagram. The compression ratio is plotted on the vertical axis and the volumetric flowrate at the compressor inlet is plotted on the horizontal axis. The first curve from the right, labeled SLL(0%) is the surge limit line for a dry gas, i.e. for a liquid volume fraction LVF=0%. The first line from the left, labeled SSL(3%) is the surge limit line for the same gas at a liquid volume fraction of 3% (i.e. LVF=3%). As can be appreciated from FIG. 2, the useful operating envelope of the compressor can increase if wet gas is processed, rather than dry gas. The surge control line also moves from the right to the left with increasing LVF values.

It would therefore be useful to determine, with a reasonable degree of approximation, the amount of liquid present in the gas flow, i.e. the LVF, since the surge control line could be moved towards the vertical axis of the compression ratio vs. flowrate diagram based on the actual LVF value, such that gas recirculation can be reduced.

In some circumstances the amount of liquid volume fraction (LVF) contained in the gas flowing through the compressor inlet 9 can be difficult to measure and such measurement may require costly and complex instrumentalities. In some situations, direct measurement of LVF may be unfeasible or inappropriate. As an alternative to direct measurement of LVF, an iterative method can be used to provide a sufficiently precise estimation of the actual liquid volume fraction, starting from easily measurable parameters of operation of the compressor 3.

Figure 3A:
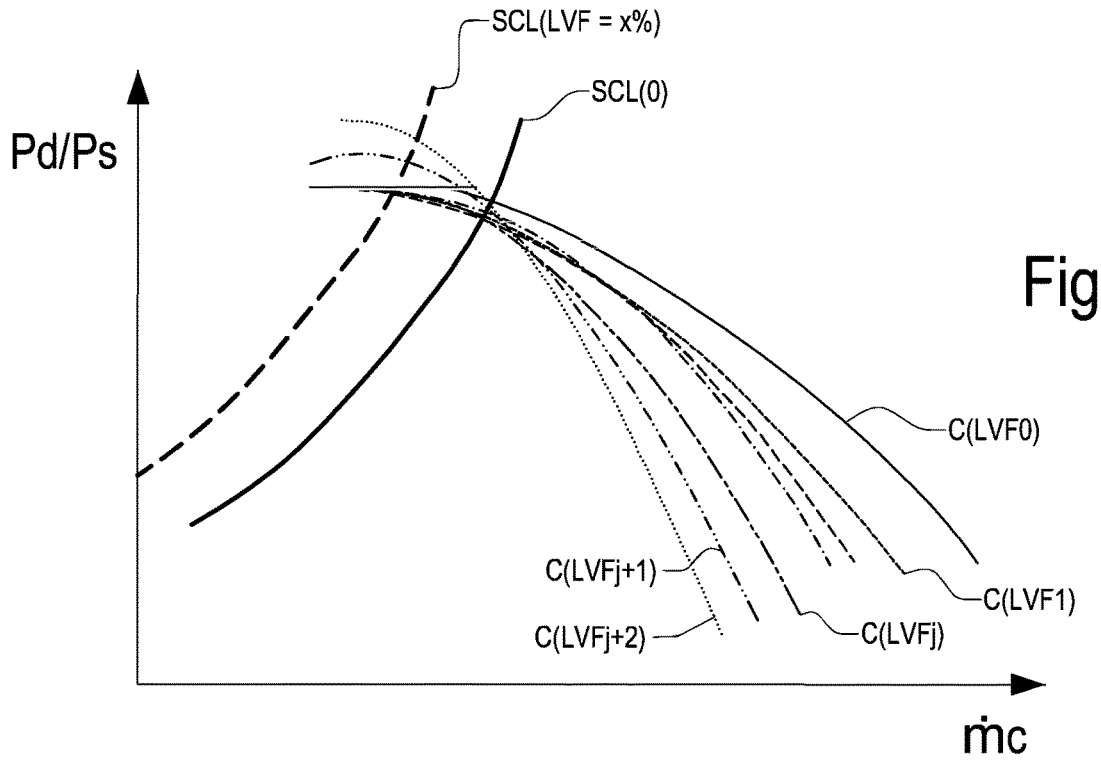
FIGS. 3A and 3B illustrate operating curve diagrams of a centrifugal compressor at variable liquid volume fractions.
Figure 3B:
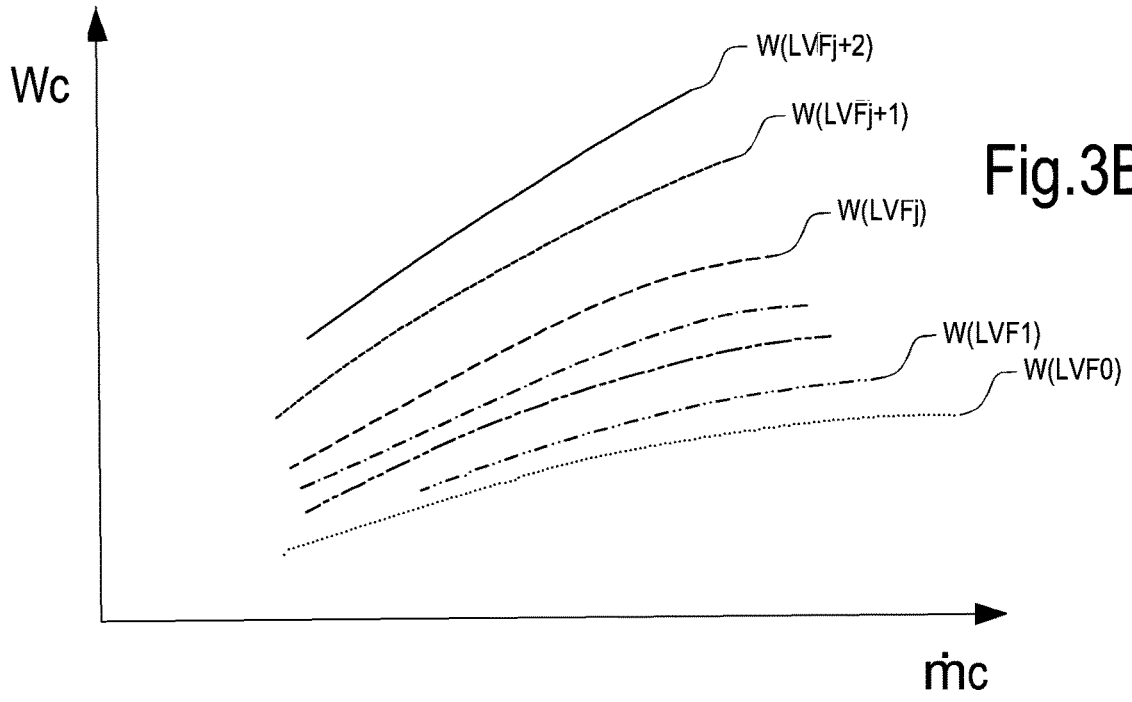
Figure 4:
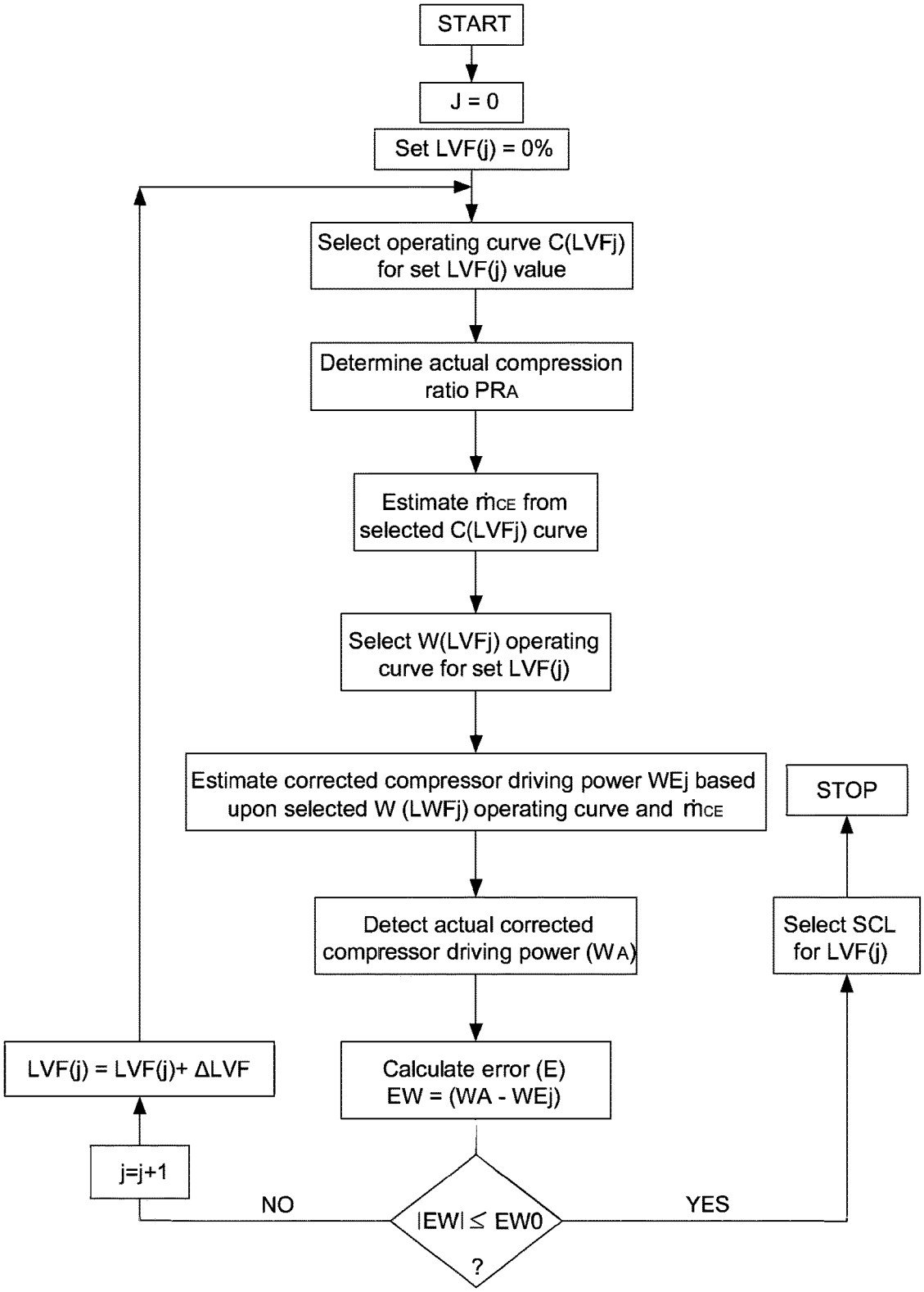
FIGS. 4, 5 and 6 illustrate flow charts of embodiments of the method according to the present disclosure.

An embodiment of the method will now be described reference being made to FIGS. 3A, 3B and 4. FIGS. 3A and 3B illustrate operating diagrams of the compressor 3, while FIG. 4 illustrates a summary flow chart of the iterative method.

More specifically, FIG. 3A illustrates a diagram where characteristic curves of compression ratio vs. a flowrate related parameter for compressor 3 are plotted. The curves of FIG. 3A are valid for a given corrected rotation speed, defined here below, and for a given mean molecular weight of the gas. Different family curves can be plotted for different rotation speeds and for different mean gas molecular weights. More specifically, the flowrate related parameter can be a mass flowrate related parameter. For instance, the flowrate related parameter reported on the horizontal axis of FIG. 3A can be a corrected mass flowrate. By corrected mass flowrate a mass flowrate can be understood, which is expressed as follows:

$$\dot{m}_C = \dot{m}\frac{\sqrt{z_{in}RT_{in}}}{P_{in}} \tag{1}$$

wherein:

$\dot{m}$ is the actual mass flow $T_{in}$ and $P_{in}$ are the temperature and the pressure, respectively, at the suction side of the compressor;

$z_{in}$ is the compressibility factor or compression factor;

R is the gas constant (also known as the molar, universal, or ideal gas constant).

The corrected rotation speed of the compressor can be expressed as $$n_C = \frac{n}{\sqrt{z_{in}RT_{in}}} \tag{2}$$

wherein n is the angular speed and the other parameters are defined above.

In FIG. 3A the compression ratio or pressure ratio PR=Pd/Ps is reported on the vertical axis and the corrected mass flowrate $\dot{m}_c$ is reported on the horizontal axis. The curve C(LVD0) represents the compression ratio as a function of the corrected mass flowrate $\dot{m}_c$ for a dry gas, i.e. for LVF=0%. The curves C(LVF1), C(LVFj), C(LVFj+1), C(LVFj+2) illustrate the relationship between the compression ratio PR and the corrected mass flowrate $\dot{m}_c$ for increasing LVF values, i.e. when gas with increasing liquid content is processed.

FIG. 3B illustrates further operating curves of the compressor 3. Each curve of FIG. 3B corresponds to a different LVF value. On the vertical axis of FIG. 3B a parameter related to the power absorbed by the compressor 3 is reported, as a function of the corrected mass flowrate $\dot{m}_C$, which is reported on the horizontal axis. The absorbed power related parameter can be a corrected power defined as follows:

$$W_c = \frac{w}{\sqrt{z_{in} R T_{in}}} \tag{3}$$

wherein W is the actual power and the remaining parameters are defined above.

In some embodiments, the above defined corrected values can be rendered dimensionless by referring the actual measured pressure and temperature values to respective pressure and temperature reference values.

The curve W(LVF0) applies for dry gas, i.e. for LVF=0%. Curves W(LVF1), . . . W(LVFj), W(LVFj+1), W(LVFj+2) are corrected power operating curves at increasing liquid volume fractions plotted as a function of the flowrate related parameter, e.g. the corrected mass flowrate $\dot{m}_C$. Once again, the curves of FIG. 3B are for a given mean molecular weight of the gas processed by the compressor and for a given corrected rotation speed of the compressor (fixed Mach number).

The curves C(LVFj) and W(LVFj) can be represented in form of tables or matrices of numeric values, wherein to each corrected mass flowrate $\dot{m}_C$ a compression ratio value (PR=Pd/Ps) and a power value (W) are associated. As stated above the curves further depend upon the rotation speed of the compressor and the gas composition. The curves plotted in FIGS. 3A and 3B, therefore, are for a given Mach number (which is in turn a function of the rotation speed of the compressor) and for a given mean gas molecular weight. The curves can be determined experimentally, by numerical simulation or a combination thereof, for instance. The data or functions representing the curves appearing in FIGS. 3A and 3B can be stored in the storage resources 33. A plurality of curve families can be stored, for a plurality of rotation speeds or corrected rotation speeds of the compressor, or Mach numbers, and for a plurality of mean molecular weights of the gas, such that if the rotation speed, the gas composition, or both change, the correct family of operation characteristic curves can be selected for calculation.

The curve SCL(0) in FIG. 3A represents the surge control curve or surge control line for a given compressor rotation speed and a given gas composition (mean molecular weight) in dry gas conditions, i.e. for LVF=0%. Curve SCL(LVF=x %) is a generic surge control curve for a wet gas having x % of liquid volume fraction (LVF=x %). The correct surge control curve to be used can be determined based on an estimation of the actual liquid content of the wet gas. The amount of liquid in the gas flow at the compressor inlet 9 can be measured, if feasible. Alternatively, to avoid the inherent difficulties involved by direct LVF measurement, the following iterative process can be performed to estimate the LVF of the inlet gas flow.

Referring to the flow chart of FIG. 4, the first step of the iterative method consists in selecting a tentative value for the liquid volume fraction, which will be indicated herein LVF(j). The tentative LVF(j) is used to start the iterative procedure. In embodiments, the first tentative LVF(j) is selected as follows:

$$\mathrm{LVF}(j)=0\%\ j=0 \tag{4}$$

i.e. it is assumed that the inlet gas is in dry conditions.

The actual compression ratio $PR_A$=Pd/Ps can be calculated by measuring the delivery pressure Pd and the suction pressure Ps of the compressor 3 using pressure transducers 21, 25. Once the actual pressure ratio or compression ratio $PR_A$ has been determined, an estimated flowrate related parameter, e.g. an estimated corrected mass flowrate $\dot{m}_{CE}$ can be calculated using curve C(LVF0) in FIG. 3A.

Based on the estimated corrected mass flowrate $\dot{m}_{CE}$, an estimated corrected power $W_E$j required to drive the compressor can be determined using the curve W(LVF0) of FIG. 3B. The actual corrected power $W_A$ required to drive the compressor 3 can be measured by means of data from the power transducer 31. The estimated corrected power value $W_E$j and actual corrected power value $W_A$ are compared and a power error $E_W$ is calculated as:

$$E_W=(W_A-W_{Ej}) \tag{5}$$

If the gas processed by the compressor 3 is actually approximately dry (i.e. LVF=0%, approximately), the error $E_W$ is around zero. An error $E_W$ outside a given range of tolerance around zero, e.g. defined by an error threshold $E_{W0}$, indicates the initially assumed value of LVF (in the present example LVF(j)=0, dry gas conditions) is incorrect and a new value for LVF(j+1) must be used at the next iterative step (j+1).

An appropriate increased value can be selected, e.g. each subsequent LVF(j) value can be increased by an amount ΔLVF=0.01% over the previous one, which means that at each $j^{th}$ iterative step the tentative LVF value LVF(j) is set as $$\mathrm{LVF}(j+1)=\mathrm{LVF}(j)+\Delta\mathrm{LVF} \tag{6}$$

The above described sequence of steps of the iterative loop is then repeated with the newly set tentative value LVF(j) of liquid volume fraction. The C(LVFj) curve for LVF=LVF(j) is selected in the diagram of FIG. 3A. Based on the measured compression ratio (Pd/Ps) and on the curve C(LVFj) for the set LVF value, the new estimated flowrate related parameter, e.g. the corrected mass flowrate $\dot{m}_C$ is determined from the diagram of FIG. 3A and used in the diagram of FIG. 3B. Based on the new $\dot{m}_{CE}$ value and on the power curve W(LVFj) for the newly set tentative value LVF(j), the estimated power related value $W_E$(j) is calculated and compared with the actual power related value $W_A$ calculated on the basis of the power measured by power transducer 31. A new error $$E_W=W_A-W_E(j) \tag{7}$$

is calculated and compared with the threshold $E_{W0}$.

The iterative process thus described ends when an error $E_W$ on the estimated power related parameter is achieved, which is equal to or lower than the error threshold $E_{W0}$. The tentative value LVF(j) to which the iterative process has converged is the estimated liquid volume fraction at the current operating conditions (current speed compressor and gas composition).

The value of LVF(j) thus determined can be used to select the optimal SCL. According to other embodiments, the SCL can be selected at each iterative loop, rather than only once the error $E_W$ has been minimized.

In the above described iterative method, two sets of operating curves have been used, namely the curves representing the compression ratio (PR=Pd/Ps) as a function of the flowrate related parameter $\dot{m}_C$ (FIG. 3A) and the curves representing the power related parameter (W) as a function of the flowrate related parameter $\dot{m}_C$ (FIG. 3B). These two families of operating curves can be merged into a single set of operating curves PR(W), which express the link between the parameter related to the power required to drive the compressor (e.g. the corrected power as defined above) and the compression ratio (PR=Pd/Ps). Each curve corresponds to a given LVF value. If these curves are available, the above described iterative calculation can be simplified as schematically shown in the flow chart of FIG. 5.

Also in this case the method can start by setting a tentative liquid volume fraction value LVF=0% and choosing the PR(W) curve corresponding to the dry gas operating conditions. Based on the measured actual compression ratio $PR_A$=(Pd/Ps), the estimated power related parameter $W_E$j can be calculated using the PR(W) curve corresponding to LVF=0%. The estimated power related value $W_E$j is then compared with the actual power related value $W_A$ measured using the power transducer 31. A power error $E_W$ is then calculated as $$E_W = W_A - W_E j \tag{8}$$

The error $E_W$ is compared with a threshold value $E_{W0}$ and, if the error is greater than the admissible error threshold $E_{W0}$, a next iterative step is performed, by setting a new tentative liquid volume fraction value $$\mathrm{LVF}(j+1) = \mathrm{LVF}(j) + \Delta\mathrm{LVF} \tag{9}$$

At each generic $j^{th}$ iterative step a tentative value LVF(j) is used to select the operative curve PR(Wj) corresponding to the set tentative LVF(j) value and the above described calculations are repeated, until the iterative process converges to an error $E_W$ that is equal to or lower than the error threshold $E_{W0}$. The corresponding tentatively LVF(j) value is assumed as the estimated LVF.

Figure 5:
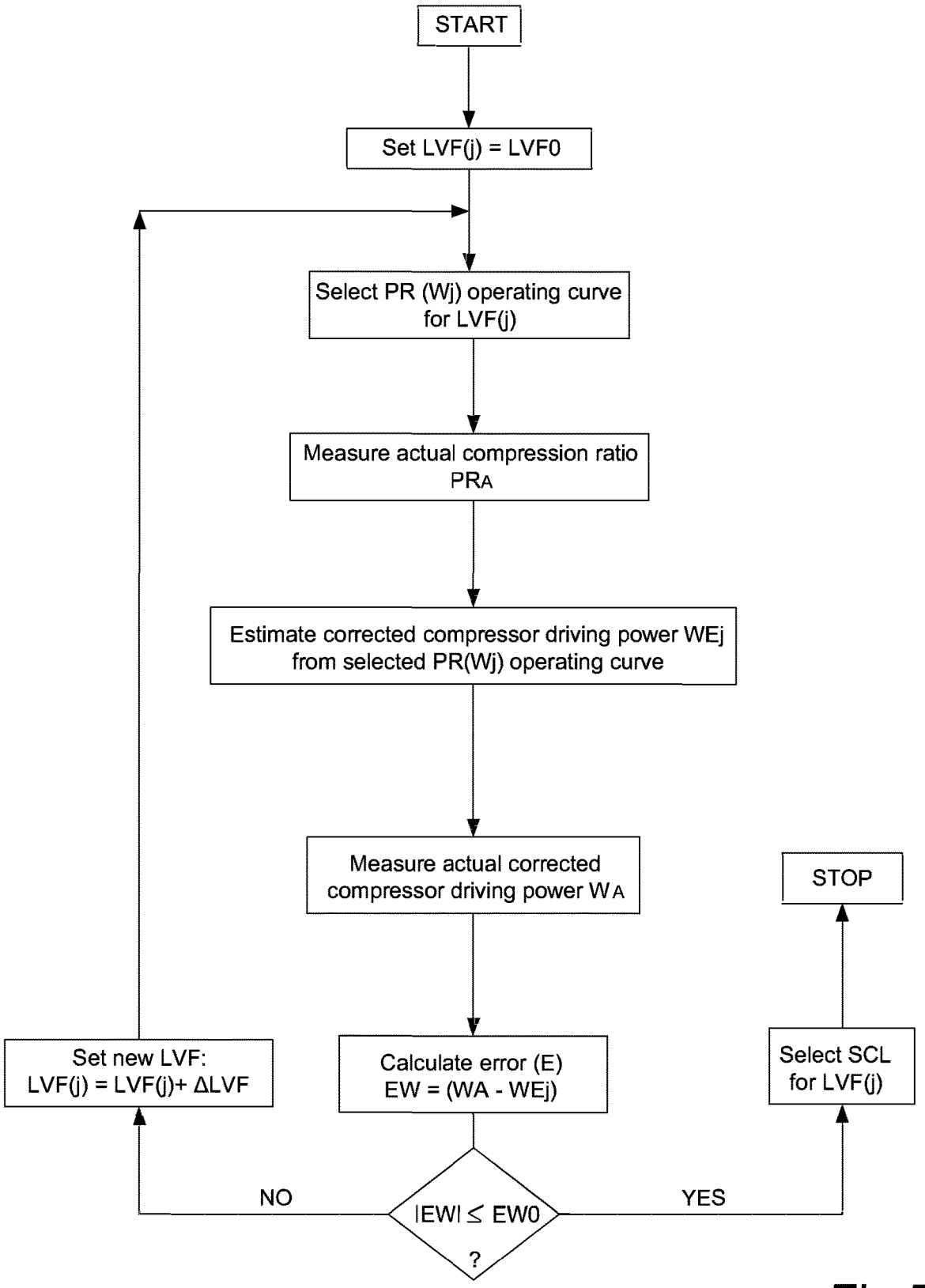
Figure 6:
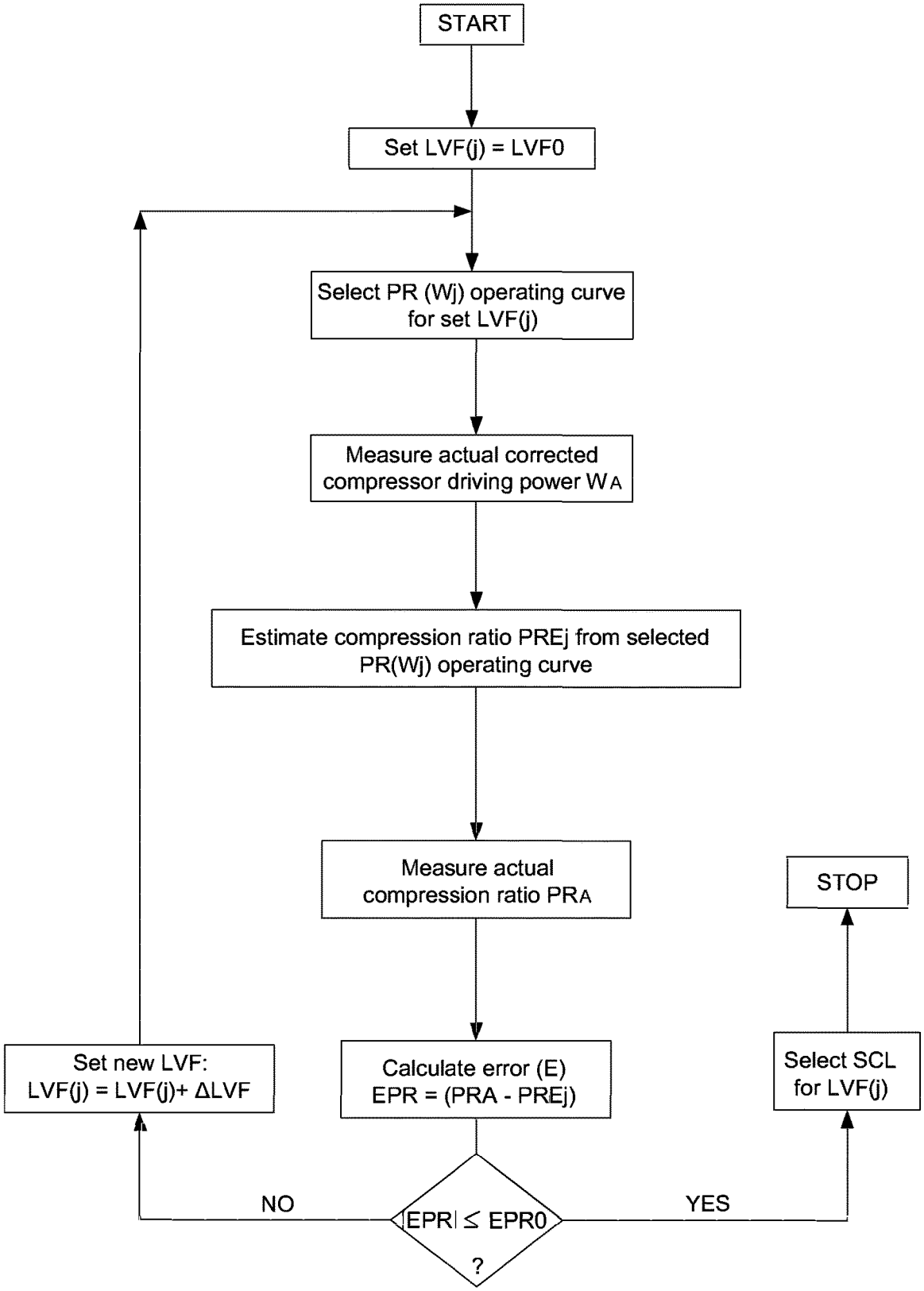

A different embodiment of the method summarized in FIG. 5 is represented by the flow chart of FIG. 6. In this case, the measured actual power related parameter $W_A$ is used and an estimated compression ratio $PR_E$j is calculated using the selected PR(Wj) curve, which corresponds to the set LVF(j) value and the actual power related parameter $W_A$. The estimated compression ratio $P_{RE}$j is then compared with a measured actual compression ratio $PR_A$ and an error $E_{PR}$ is calculated therefrom. If the error $E_{PR}$ is above an error threshold $E_{PR0}$, the method is re-iterated with a newly set tentative LVF value $$\mathrm{LVF}(i) = \mathrm{LVF}(i) + \Delta\mathrm{LVF} \tag{10}$$

as shown in the flow chart of FIG. 6.

In all embodiments disclosed so far, a first compressor operating parameter and a second compressor operating parameter are used. According to the embodiment of FIGS. 3 and 4, the first compressor operating parameter is the compression ratio PR=(Pd/Ps), while the second compressor parameter is the power or a power related parameter, e.g. the corrected power. A flowrate related parameter, for instance the corrected mass flowrate $\dot{m}_C$ is used as an intermediate parameter linking the two families of operating curves shown in FIGS. 3A and 3B.

In the embodiment of FIG. 5 the first operating parameter is once again the compression ratio PR=(Pd/Ps), and the second compressor operating parameter is the power related parameter, e.g. the corrected power $W_C$. In the embodiment of FIG. 6, the first operating parameter is the power related parameter, while the second operating parameter is the compression ratio PR=Pd/Ps.

In the above described embodiments the starting point of the iterative process is LVF=0, i.e. the first iterative loop is performed assuming that dry gas is processed. This is convenient, since if the calculated error is above an error threshold, there is only one way of implementing the next iterative step, namely by increasing the assumed LVF value. However, in embodiments of the method described herein, the starting point of the iterative process can be any value for LVF. A sort of perturb-and-observe method can then be implemented. If the calculated error is above the admitted threshold, the assumed LVF is either increased or decreased. If the error calculated at the next iterative step is higher than the previously calculated error, the subsequent iterative loop will start by modifying the LVF in the opposite direction: it will be decreased if the previous iterative loop was executed by increasing the LVF value; otherwise, it will be increased, if the previous iterative loop was executed by decreasing LVF value.

In some embodiments, the LVF of the gas being processed can be estimated on the basis of thermodynamic calculations. The estimated value can be used as the starting point for one of the iterative methods disclosed above. Since in this case the estimated LVF value is different than zero, a perturb-and-observe iterative process can be used. The estimation of the starting LVF value is determined e.g. based on the gas composition, and upon the following parameters: suction pressure (Ps), delivery pressure (Pd), suction temperature (Ts) and delivery temperature (Td) of the gas processed by the compressor 3.

Since the operating curves change as a function of the rotation speed of the compressor, the rotation speed or the corrected rotation speed as defined by equation (2) can be used as a further parameter to select the proper family of operating curves each time the iterative process is performed.

The same holds true for the mean molecular weight of the gas. Different operating curves apply for different chemical compositions of the gas processed through the compressor 3. The chemical composition, and thus the molecular weight, of the gas is usually a slow-changing parameter. For instance, in case of gas wells, the composition remains quasi-constant and an update of the gas composition can be performed e.g. once a day or even less frequently. The gas composition can be analyzed off-line, e.g. in a laboratory using gas samples. Based on the result of the analysis the proper operating curves can be selected manually, for instance. On-line gas composition analysis can also be performed, e.g. by means of a gas chromatograph. The proper operating curves can be selected automatically. The mean molecular weight of the gas can be calculated based on the chemical composition.

The above described calculation methods can be performed continuously, or at a given frequency to monitor the actual LVF of the gas at the suction side of the compressor 3. For instance, the above described calculations can be re-started at given time intervals.

However, in order to render the above calculations more efficient, and to reduce the computational load, in some embodiments measures can be met to reduce the number of iterative calculations performed, or else to reduce the frequency wherewith these calculations are performed.

For instance, since the liquid volume fraction depends upon the suction pressure Ps and the suction temperature Ts of the gas, the other parameters (e.g. compressor rotation speed and gas composition) being the same, once the iterative method used has converged towards an error below the error threshold, the iterative calculation can be stopped. A new calculation to estimate the LVF can be performed only upon detection of a pressure or temperature fluctuation at the suction side 9 of the compressor 3. In other embodiments, the iterative calculations can be repeated periodically, but with a frequency that can be made dependent upon the fluctuation of the pressure and/or temperature at the suction side of compressor 3, i.e. the larger the fluctuations the more frequent the repetition of the iterative calculation.

In order to further simplify the method and reduce computational load, measures can be taken in order to perform the above described iterative calculation only if a preliminary routine establishes that wet gas is present at the suction side 9 of compressor 3. If the preliminary routine determines that dry gas is present at the suction side 9 of compressor 3, no estimation of the LVF is performed, since the actual value of the liquid volume fraction is zero.

A possible embodiment of a preliminary routine will be described here below, reference being made to the flow chart of FIG. 7.

The first step of the preliminary routine provides for measuring the volumetric flowrate $Q_{VD}$ at the delivery side of the compressor 3, e.g. by means of flowmeter 29. Based upon the measured temperatures Ts and Td at the suction side and delivery side of the compressor 3, upon the measured pressures Ps and Pd at the suction side and delivery side, as well as on the basis of the gas composition and assuming that dry gas is present at the suction side 9 of the compressor 3, an estimated mass flow rate is calculated. The estimated corrected mass flowrate $(\dot{m}_{CS})_E$ at the suction side 9 of the compressor 3 can then be calculated using equation (1). Based on the estimated $(\dot{m}_{CS})_E$ value and using the C(LVF0) curve of FIG. 3A, an estimated pression ratio $PR_E$ can be determined. The actual pressure ratio $PR_A$ is determined based upon the measured suction side pressure Ps and delivery side pressure Pd. The compression ratio error $E_{PR}$ $$E_{PR}=PR_A-PR_E \tag{11}$$

is then calculated and compared with an error threshold $E_{PR0}$. If the error $E_{PR}$ is equal to or lower than the error threshold $E_{PR0}$, the assumption that the gas is dry at both the delivery side and the suction side can be assumed to be correct. Otherwise, if the calculated error $E_{PR}$ is above the error threshold $E_{PR0}$, the conclusion is drawn that wet gas conditions are present at least at the suction side 9 of the compressor 3. In the first case (dry gas), no routine will be started to determine the actual LVF. In the second case, one of the routines for estimating the actual LVF, as summarized in FIG. 4, 5 or 6 and described above, will be called and executed.

Figure 8:
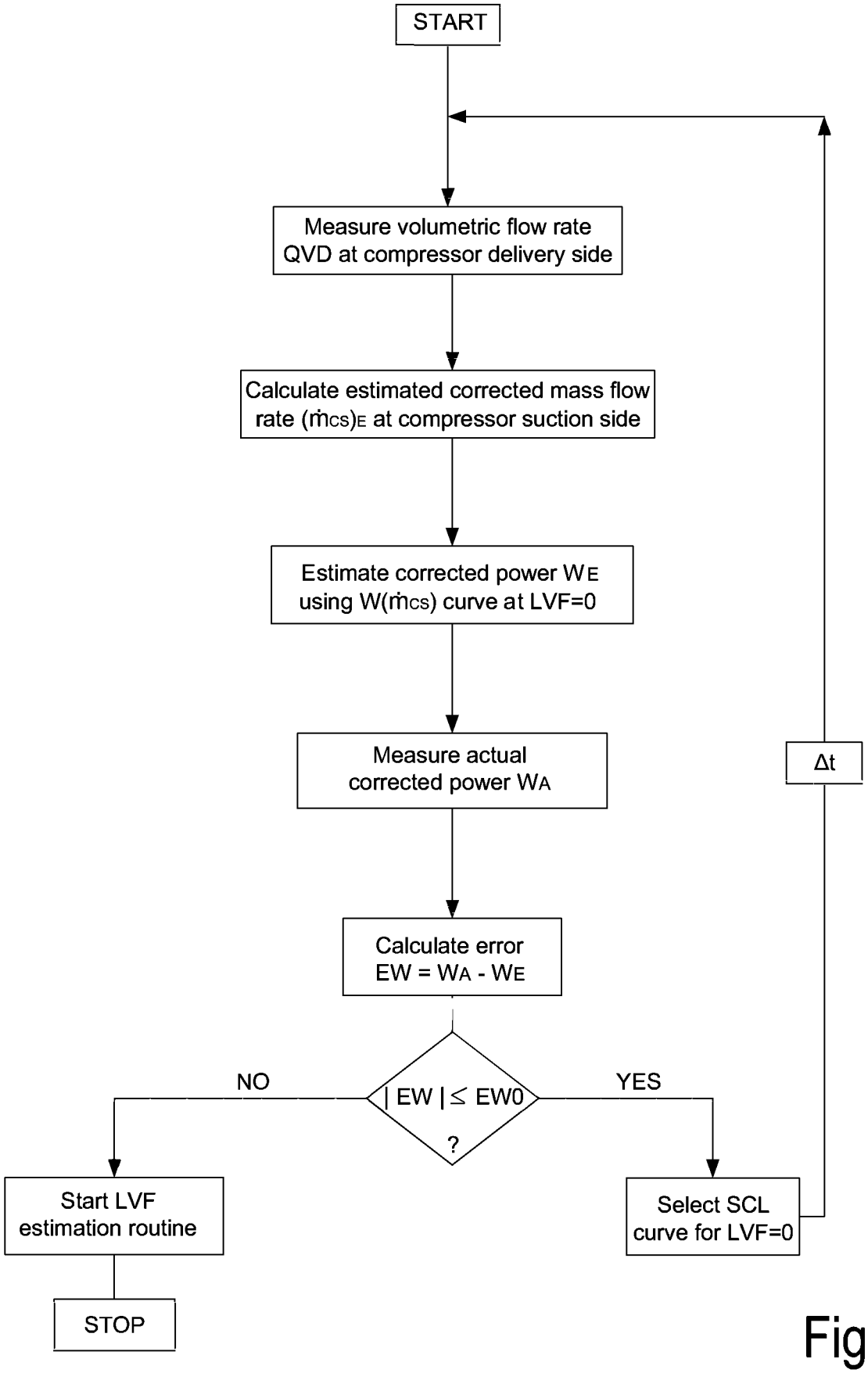

FIG. 8 illustrates a further embodiment of a preliminary routine for establishing whether wet gas is present at the suction side 9 of compressor 3. The first step of the preliminary routine provides again for measuring the volumetric flowrate $Q_{VD}$ at the delivery side of the compressor 3, e.g. by means of flowmeter 29. Based upon the measured temperatures Ts and Td at the suction side and delivery side, upon the measured pressures Ps and Pd at the suction side and delivery side, as well as on the basis of the gas composition and assuming that dry gas is present at the suction side 9 of the compressor 3, an estimated mass flow rate and then a corrected mass flowrate $(\dot{m}_{CS})_E$ at the suction side 9 of the compressor 3 can be calculated, again using equation (1). Based on the estimated $(\dot{m}_{CS})_E$ value and using the W(LVF0) curve of FIG. 3B, an estimated compressor power related parameter, e.g. an estimated corrected power $W_E$ can be determined using equation (3). The actual power related parameter $W_A$ is also measured e.g. by means of transducer 31. The power error $E_W$ $$E_W=W_A-W_E \tag{12}$$

is then calculated and compared with an error threshold $E_{W0}$. If the error $E_W$ is equal to or lower than the error threshold $E_{W0}$, the assumption that the gas is dry at both the delivery side and the suction side can be assumed to be correct. Otherwise, if the calculated error $E_W$ is above the error threshold $E_{W0}$, the conclusion is drawn that wet gas conditions are present at least at the suction side 9 of the compressor 3. In the first case (dry gas), no routine will be started to determine the actual LVF. In the second case, one of the routines for estimating the actual LVF, as summarized in FIG. 4, 5 or 6 and described above, will be called and executed.

Figure 7:
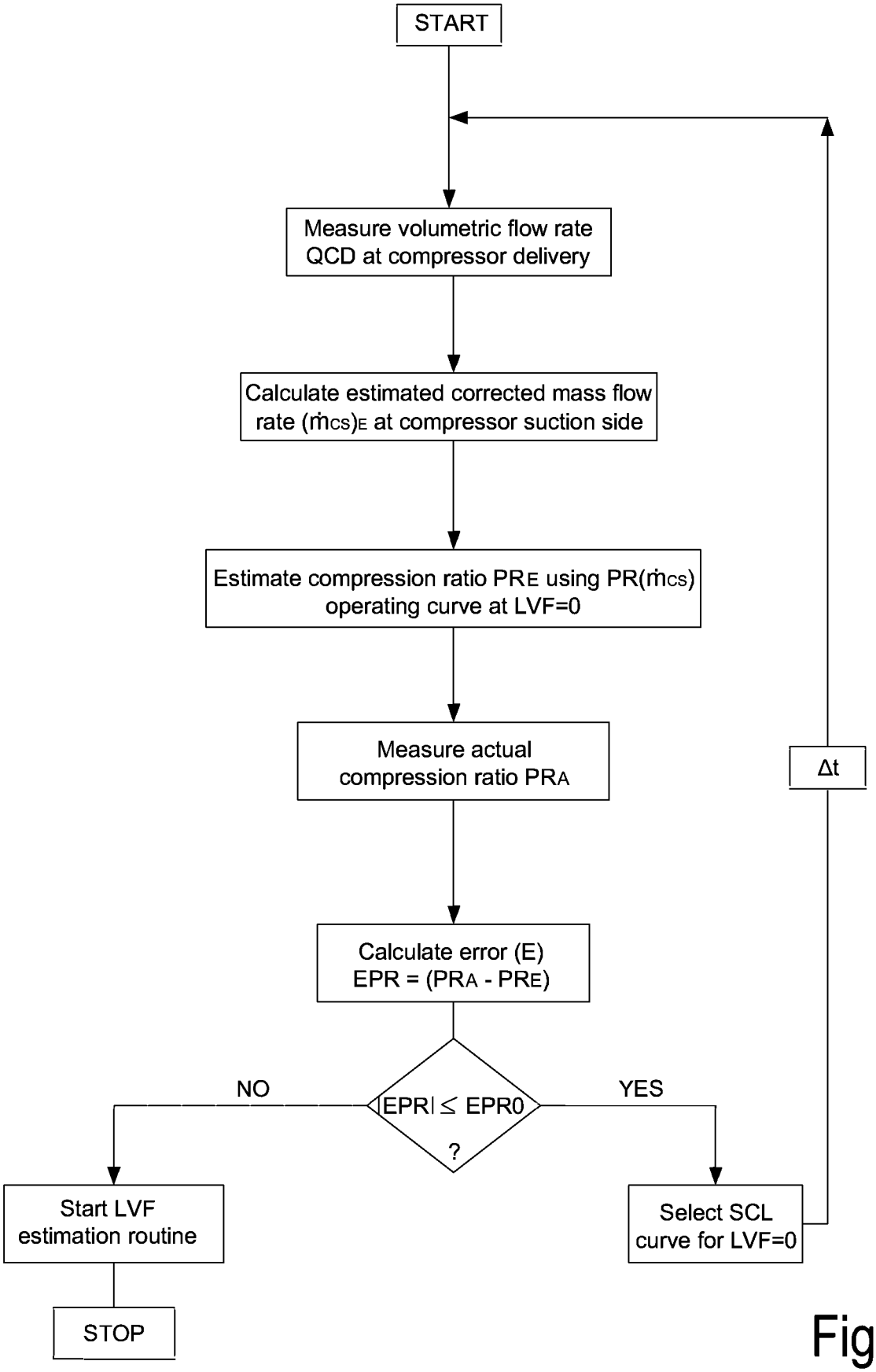
FIGS. 7 and 8 illustrate flow charts for preliminary routines.

In both embodiments of FIGS. 7 and 8, if a dry-gas condition is detected, the preliminary routine can be repeated after a constant or variable time interval Δt, to check whether the dry-gas conditions are still valid. The routine of FIG. 8 is preferred, since the curves used do not intersect and therefore this routine provides more accurate results. In some embodiments the routine of FIG. 7 can be performed first and then the result can be checked by performing the routine of FIG. 8.

Based on the above described method, the estimated liquid volume fraction LVF of the gas processed by the compressor 3 is determined with a sufficient accuracy and the estimated value can be used to select the optimal surge control curve SCL(LVF=x %) (FIG. 3A). In this way, when wet gas is processed, the surge control curve can be shifted in the operating map accordingly, extending the envelope wherein the compressor 3 can operate, thus reducing the intervention of the anti-surge control valve 15. The waste of power caused by gas recirculation for surge control is reduced and the overall efficiency of the compressor 3 is thus increased.

The above described method of LVF estimation can be used also for purposes different than surge control, whenever the liquid volume fraction of a wet gas shall be calculated.

The above described embodiments use methods for calculating the liquid volume fraction LVF of the gas processed by the compressor, e.g. in order to select a proper surge control line, in order to adapt surge control to the actual content of liquid in a wet gas.

The calculation methods described so far allow the LVF to be determined avoiding measurement of the actual liquid content at the suction side of the compressor. However, in order to adapt the surge control to the potentially variable content of the liquid in the gas, measurement of the LVF, rather than estimation thereof based on the above iterative calculation methods is not excluded.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of determining a liquid volume fraction in a multi-phase gas processed by a compressor having a suction side and a delivery side, the method comprising:

a) measuring a first compressor operating parameter;

b) selecting a tentative liquid volume fraction of the gas processed by the compressor;

c) based on stored data representing a compressor operative curve for the tentative liquid volume fraction, determining an estimated value of a second compressor operating parameter as a function of the first compressor operating parameter, wherein the second compressor operating parameter is one of a parameter related to the compressor driving power and a compression ratio related parameter;

d) measuring an actual value of the second compressor operating parameter;

e) comparing the actual value of the second compressor operating parameter to the estimated value of the second compressor operating parameter and determining an error therefrom; and f) based on the error, selecting a different tentative liquid volume fraction and repeating (c) to (e) until an error value equal to or lower than an error threshold is obtained.

2. A method of determining a liquid volume fraction in a multi-phase gas processed by a compressor having a suction side and a delivery side, the method comprising:

a) measuring a first compressor operating parameter;

b) selecting a tentative liquid volume fraction of the gas processed by the compressor;

c) based on stored data representing a compressor operative curve for the tentative liquid volume fraction, determining an estimated value of a second compressor operating parameter as a function of the first compressor operating parameter;

d) measuring an actual value of the second compressor operating parameter;

e) comparing the actual value of the second compressor operating parameter to the estimated value of the second compressor operating parameter and determining an error therefrom; and f) based on the error, selecting a different tentative liquid volume fraction and repeating (c) to (e) until an error value equal to or lower than an error threshold is obtained, wherein determining the estimated value of the second compressor operating parameter further comprises:

based on stored data representing the compressor operative curve for the tentative liquid volume fraction, determining an estimated value of a third compressor operating parameter; and based on stored data representative of a further compressor operative curve for the tentative liquid volume fraction, and based on the estimated value of the third compressor operating parameter, determining the estimated value of the second compressor operating parameter.

3. The method of claim 2, wherein: the first compressor operating parameter is a compression ratio related parameter; the second compressor operating parameter is a parameter related to the compressor driving power; and the third compressor operating parameter is a flowrate related parameter.

4. The method of claim 3, wherein the further compressor operative curve expresses the compression ratio related parameter as a function of a flowrate related parameter or vice-versa.

5. A method of determining a liquid volume fraction in a multi-phase gas processed by a compressor having a suction side and a delivery side, the method comprising:

a) measuring a first compressor operating parameter;

b) selecting a tentative liquid volume fraction of the gas processed by the compressor;

c) based on stored data representing a compressor operative curve for the tentative liquid volume fraction, determining an estimated value of a second compressor operating parameter as a function of the first compressor operating parameter;

d) measuring an actual value of the second compressor operating parameter;

e) comparing the actual value of the second compressor operating parameter to the estimated value of the second compressor operating parameter and determining an error therefrom; and f) based on the error, selecting a different tentative liquid volume fraction and repeating (c) to (e) until an error value equal to or lower than an error threshold is obtained, wherein the first compressor operating parameter or the second compressor operating parameter is one of a compression ratio related parameter and a parameter related to the compressor driving power, and the parameter related to compressor driving power is one of a compressor driving power and a corrected power.

6. The method of claim 5, wherein the first compressor operating parameter is one of a compression ratio related parameter and a parameter related to the compressor driving power.

7. The method of claim 5, wherein the flowrate related parameter is one of a mass flowrate and a corrected mass flowrate.

8. A method of determining a liquid volume fraction in a multi-phase gas processed by a compressor having a suction side and a delivery side, the method comprising:

a) measuring a first compressor operating parameter;

b) selecting a tentative liquid volume fraction of the gas processed by the compressor;

c) based on stored data representing a compressor operative curve for the tentative liquid volume fraction, determining an estimated value of a second compressor operating parameter as a function of the first compressor operating parameter;

d) measuring an actual value of the second compressor operating parameter;

e) comparing the actual value of the second compressor operating parameter to the estimated value of the second compressor operating parameter and determining an error therefrom;

f) based on the error, selecting a different tentative liquid volume fraction and repeating (c) to (e) until an error value equal to or lower than an error threshold is obtained; and g) selecting the compressor operative curve as a function of (i) a chemical parameter of the gas, or (ii) as a function of a compressor rotation speed or a compressor corrected rotation speed.

9. The method of claim 8, wherein the chemical parameter of the gas is the mean molecular weight of the gas.

10. The method of claim 5, further comprising performing a preliminary routine to determine if wet gas or dry gas is present at the suction side of the compressor.

11. The method of claim 5, wherein the step of selecting a tentative liquid volume fraction of the gas processed by the compressor includes the step of selecting a liquid volume fraction equal to zero.

12. A method of determining a liquid volume fraction in a multi-phase gas processed by a compressor having a suction side and a delivery side, the method comprising:

a) measuring a first compressor operating parameter;

b) selecting a tentative liquid volume fraction of the gas processed by the compressor;

c) based on stored data representing a compressor operative curve for the tentative liquid volume fraction, determining an estimated value of a second compressor operating parameter as a function of the first compressor operating parameter;

d) measuring an actual value of the second compressor operating parameter;

e) comparing the actual value of the second compressor operating parameter to the estimated value of the second compressor operating parameter and determining an error therefrom; and f) based on the error, selecting a different tentative liquid volume fraction and repeating (c) to (e) until an error value equal to or lower than an error threshold is obtained, wherein selecting a tentative liquid volume fraction of the gas processed by the compressor includes thermodynamically estimating the liquid volume fraction based upon temperature and pressure measurements at the suction side and at the delivery side of the compressor and upon information on a chemical parameter of the gas, a mean molecular weight of the gas.

13. A method of determining a liquid volume fraction in a multi-phase gas processed by a compressor having a suction side and a delivery side, the method comprising:

a) measuring a first compressor operating parameter;

b) selecting a tentative liquid volume fraction of the gas processed by the compressor;

c) based on stored data representing a compressor operative curve for the tentative liquid volume fraction, determining an estimated value of a second compressor operating parameter as a function of the first compressor operating parameter;

d) measuring an actual value of the second compressor operating parameter;

e) comparing the actual value of the second compressor operating parameter to the estimated value of the second compressor operating parameter and determining an error therefrom;

f) based on the error, selecting a different tentative liquid volume fraction and repeating (c) to (e) until an error value equal to or lower than an error threshold is obtained; and g) selecting a surge control line based upon the estimated liquid volume fraction of wet gas processed by the compressor.

14. A system comprising:

a driver;

a compressor drivingly coupled to the driver and comprised of an anti-surge arrangement including an anti-surge line and an anti-surge control valve arranged there along;

a control unit functionally coupled to the anti-surge valve;

wherein the control unit is configured and controlled to perform a method according to claim 1.

15. A method of operating a wet-gas compressor, comprising:

running the compressor and processing a gas there through;

determining a liquid volume fraction of the gas at the suction side of the compressor;

selecting a surge control line as a function of the liquid volume fraction;

providing sets of operating curves and surge control lines of the wet-gas compressor at different liquid volume fractions; and selecting the set of operating curves and respective surge control line corresponding to the determined liquid volume fraction.

16. The method of claim 15, wherein determining the liquid volume fraction at the suction side of the compressor is performed repeatedly during operation of the compressor.

17. The method of claim 15, wherein determining the liquid volume fraction of the gas comprises estimating the liquid volume fraction based on measures of operating parameters of the compressor.

18. The method of claim 17, wherein the operating parameters include a parameter related to the compression ratio across the compressor and a parameter related to the power for driving the compressor.

19. The method of claim 15, wherein determining the liquid volume fraction of the gas comprises detecting the amount of liquid in a multi-phase flow meter.

20. The method of claim 15, further comprising determining a mean molecular weight of the gas and selecting the surge control line as a further function of the mean molecular weight.

21. The method of claim 15, further comprising determining a rotation speed of the compressor and selecting the surge control line as a further function of a parameter related to the rotation speed of the compressor.

22. A compressor system comprising:

a wet-gas compressor having a suction side and a delivery side;

an anti-surge arrangement comprising an anti-surge line fluidly coupling the delivery side and the suction side of the compressor and including an anti-surge control valve there along;

a control unit, functionally connected to the anti-surge control line, configured and arranged to determine a liquid volume fraction of the gas at the suction side of the compressor and select a surge control line as a function of the liquid volume fraction according to the method of claim 17, and act upon the anti-surge control valve to prevent the compressor from operating beyond the selected surge control line.

* * * * *